US005588406A

United States Patent [19]

Ito et al.

[11] Patent Number: 5,588,406

[45] Date of Patent: Dec. 31, 1996

[54] STRUCTURE FOR LUBRICATING CAM SLIDING SURFACE IN AN INTERNAL COMBUSTION ENGINE

[75] Inventors: Katsuhiko Ito; Hideo Kobayashi; Yukio Ishiuchi; Toshio Shimada, all of Saitama, Japan

[73] Assignee: Honda Giken Kogyo Kabushiki Kaisha, Tokyo, Japan

[21] Appl. No.: 501,863

[22] Filed: Jul. 13, 1995

[30] Foreign Application Priority Data

Jul. 13, 1994 [JP] Japan ..... 6-184101

[51] Int. Cl.[6] ..... F01M 9/10; F01M 1/06; F01L 1/04

[52] U.S. Cl. ..... 123/90.34; 123/90.6

[58] Field of Search ..... 123/90.33, 90.34, 123/90.36, 90.6, 196 R, 196 M; 184/6.5, 6.9; 74/567

[56] References Cited

U.S. PATENT DOCUMENTS

| | | | |
|---|---|---|---|
| 4,711,203 | 12/1987 | Seidl | 123/90.34 |
| 4,881,496 | 11/1989 | Kronich | 123/90.33 |
| 4,995,353 | 2/1991 | Stegeman et al. | 123/90.6 |
| 5,081,880 | 1/1992 | Swars | 123/90.6 |
| 5,186,129 | 2/1993 | Magnan et al. | 123/90.33 |

FOREIGN PATENT DOCUMENTS

| | | | |
|---|---|---|---|
| 3602477 | 7/1986 | Germany | 123/90.33 |
| 57-142112 | 9/1982 | Japan . | |
| 59-96315 | 6/1984 | Japan . | |

*Primary Examiner*—Weilun Lo

*Attorney, Agent, or Firm*—Birch, Stewart, Kolasch & Birch, LLP

[57] ABSTRACT

Recessed portions extending in the direction of the cam shaft from the opposed edges of the intake cam and the exhaust cam are respectively formed on the base circles of the intake cam and the exhaust cam of the cam shaft. Moreover, projecting ribs crossing a predetermined circumference of the cam shaft, having rib end portions directed toward the recessed portions, and extending in the rotational direction of the cam shaft, are radially projectingly provided on the cam shaft adjacent to the recessed portions.

17 Claims, 22 Drawing Sheets

STRUCTURE FOR LUBRICATING CAM SLIDING SURFACE IN AN INTERNAL COMBUSTION ENGINE

BACKGROUND OF THE INVENTION

1. Field of the Invention

The present invention relates to a structure for lubricating a cam sliding surface in an internal combustion engine.

2. Description of Background Art

In a valve system using a push rod in a prior art overhead-valve internal combustion engine, for lubricating a sliding surface between a tappet positioned at the lower portion of a push rod and a cam, a hole is opened in the lower peripheral wall of a cylindrical and bottoming tappet with a top portion opened, so that lubricating oil after lubricating a rocker shaft and rocker arm of a cylinder head is dropped and reserved in the cylindrical and bottoming tappet, and is discharged from the above hole (Unexamined Japanese Utility Model Publication Nos. SHO 57-142112 and SHO 59-96315).

Since a tappet is made of a hard material excellent in wear resistance for withstanding the friction with a cam, it is difficult to be formed with a hole. Moreover, the lubricating oil discharged from the hole of the tappet is not wholly supplied to the sliding surface. Accordingly various structures must be adopted for sufficiently lubricating the sliding surface.

SUMMARY AND OBJECTS OF THE INVENTION

An object of the present invention is to provide a structure for lubricating a cam sliding surface of a valve system in an internal combustion engine, which is capable of solving the above-described problem. To achieve the above object, according to a preferred mode of the present invention, there is provided a structure for lubricating a cam sliding surface in an internal combustion engine, characterized in that recessed portions extending in the direction of a cam shaft are formed on base circles of intake and exhaust cams. Projecting ribs cross a predetermined circumference of the cam shaft and include rib end portions directed toward the recessed portions and extend in the rotational direction of the cam shaft. The rib end portions radially project from the cam shaft adjacent to the recessed portions.

With this construction, the lubricating oil dammed up by the projecting ribs is introduced toward the recessed portions provided on the base circles of the intake and exhaust cams, and is then supplied from the recessed portions to the base circles of the intake and exhaust cams, thereby sufficiently lubricating the sliding surfaces between the base circles of the intake and exhaust cams and the tappets. In the present invention, since the tappet is subject to no machining, it is possible to reduce the cost.

A lubricating oil path is preferably provided for dropping lubricating oil on the projecting ribs. With this construction, it becomes possible to sufficiently supply lubricating oil to the ribs and the peripheral portions thereof without any special oil supply means.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, one embodiment of the present invention will be described with reference to the drawings.

Figure 1:
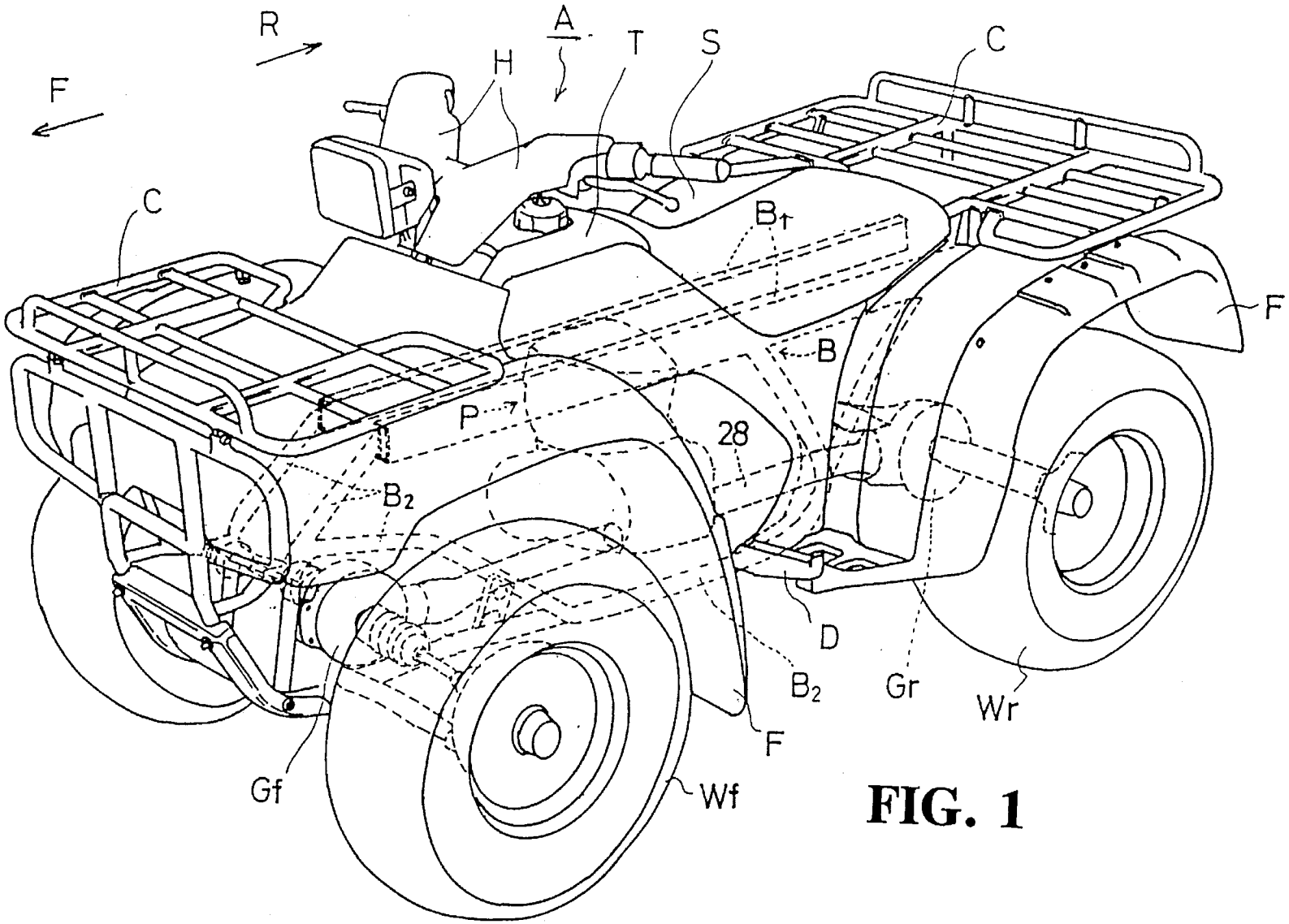
FIG. 1 is a schematic perspective view of an off-road running saddle type vehicle mounting a vehicular power unit of the present invention.

FIG. 1 shows an off-road running saddle type vehicle A called a buggy. In this vehicle A, a pair of right and left channel shaped main frames $B_1$ extend in the longitudinal direction on the upper side of a vehicular body, and pipe shaped frames $B_2$ are integrated with the lower portions of the channel shaped main frames $B_1$. Pairs of right and left front wheels Wf and rear wheels Wr, each mounting a balloon tire, are respectively provided on the front and rear portions of a vehicular frame B composed of the channel shaped main frames $B_1$ and the pipe shaped frames $B_2$.

A steering handle H, a fuel tank T and a seat S are disposed from the front side to the rear side in this order on the upper side of the vehicle A. Under the fuel tank T and seat S, a power unit P for driving the front wheels Wf and the rear wheels Wr is mounted at the central portion of the vehicular frame B.

The vehicle A is also provided with fenders F for nearly covering the upper portions of the front wheels Wf and the rear wheels Wr, and with the carriers C positioned over the upper surfaces of the fenders F.

Steps D for supporting two feet of an operator sitting astride the seat S are disposed on the lower side of the central portion of the vehicular frame B. A brake pedal (not shown) is disposed near the right step D, and a change pedal (not shown) is disposed near the left step D.

Figure 2:
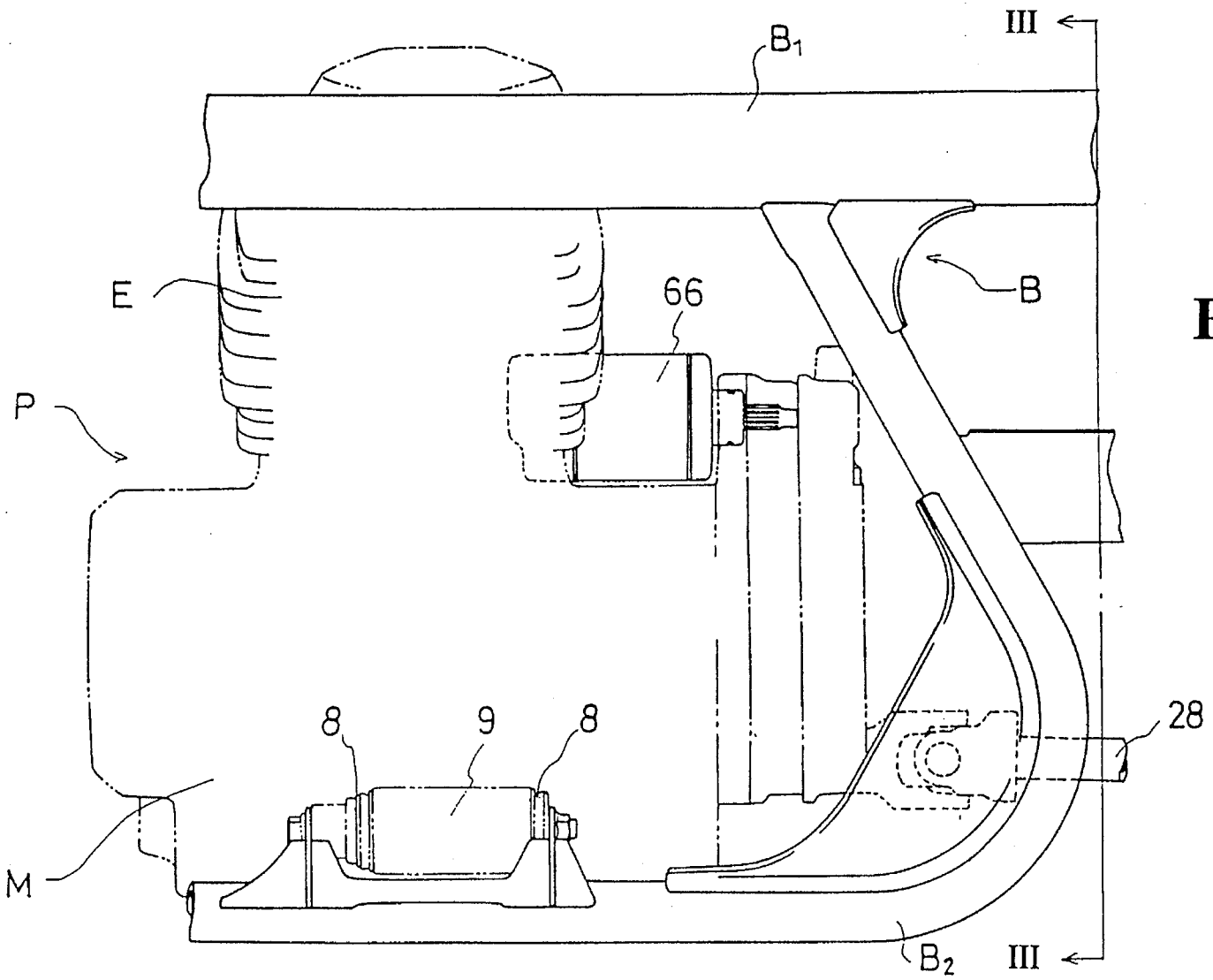
FIG. 2 is an enlarged side view of an essential portion of the vehicle shown in FIG. 1.
Figure 3:
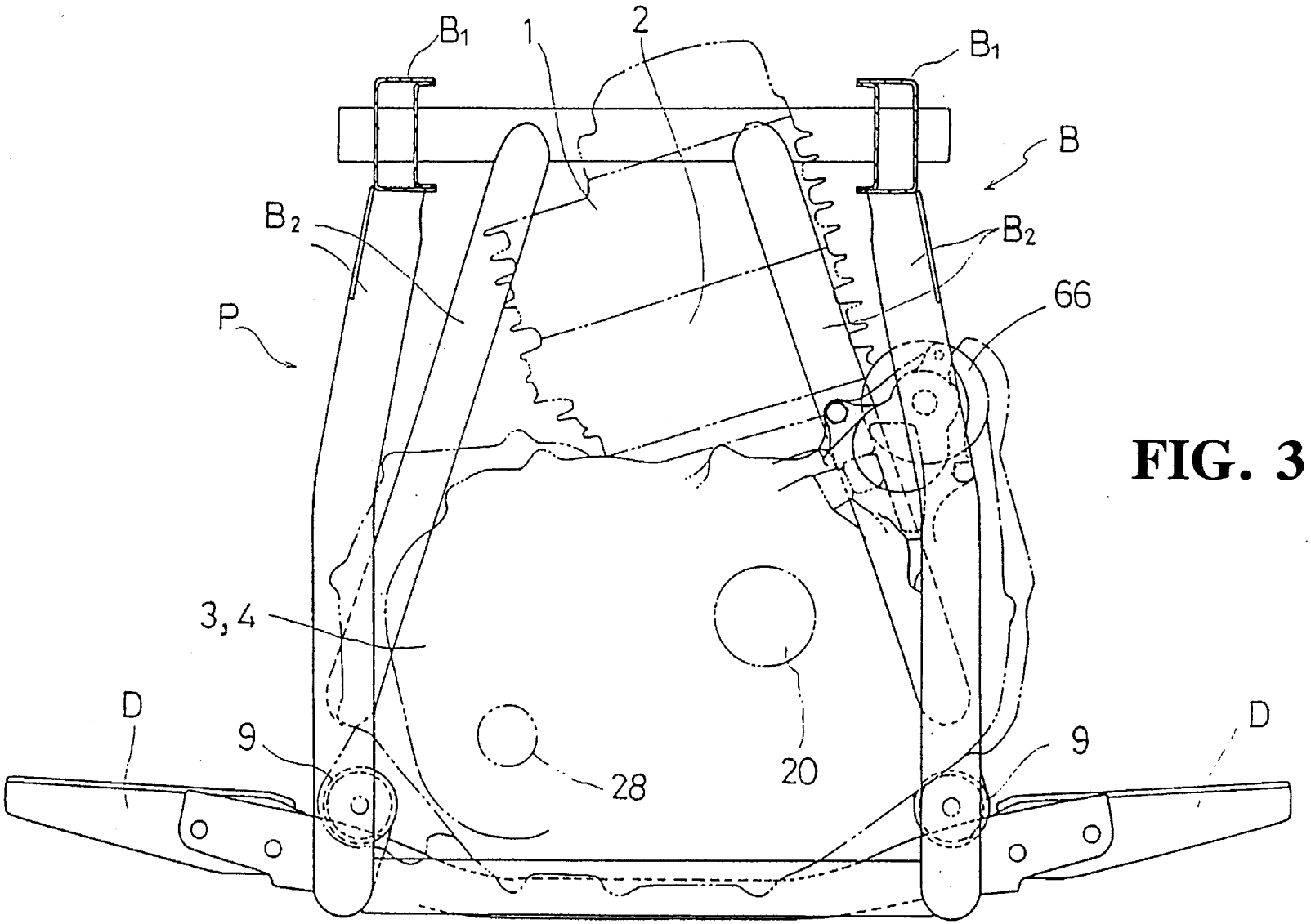
FIG. 3 is a sectional view taken along line III—III of FIG. 2.

The power unit P includes a crank case of an internal combustion engine E and a transmission case of a transmission M, which are integrated with each other. The internal combustion engine E is divided into a cylinder head 1, cylinder block 2, a front crank case 3, a rear crank case 4, a front case cover 5, and a rear case cover 6. An shown in FIGS. 2 and 3, the front crank case 3 and the rear crank case 4 are integrated with each other by means of connecting bolts (not shown) which are connected to the right and left pipe shaped frames $B_2$ through elastic mount members 9 by means of mounting bosses 8 on both the sides of the lower portions of the front and rear crank cases 3, 4.

As shown in FIGS. 6 to 9, the cylinder block 2 is superposed on the front and rear crank cases 3, 4 which are integrally connected to each other. Cylinder-case connecting bolts 11 are screwed in two bolt holes 10 provided in the cylinder block 2 and the front and rear crank cases 3, 4. The cylinder head 1 and a rocker arm holder 19 are superposed on the cylinder block 2, and a holder-head-cylinder connecting bolt 13 is screwed in a bolt hole 12 provided in the rocker arm holder 19, cylinder head 1 and cylinder block 2. A head-cylinder connecting bolt 15 is screwed in a bolt hole 14 provided in the cylinder head 1 and the cylinder block 2. Head-cylinder-case connecting bolts 17 are screwed into two bolt holes 16 provided in the cylinder head 1, cylinder block 2, front crank case 3 and rear crank case 4. Connecting bolts (not shown) are screwed in bolt holes 18 provided in the rocker arm holder 19, cylinder head 1, cylinder block 2, front crank case 3, and rear crank case 4. The cylinder head 1, cylinder block, 2, front crank case 3, rear crank case 4, and rocker arm holder 19 are thus integrally connected to each other.

Figure 5:
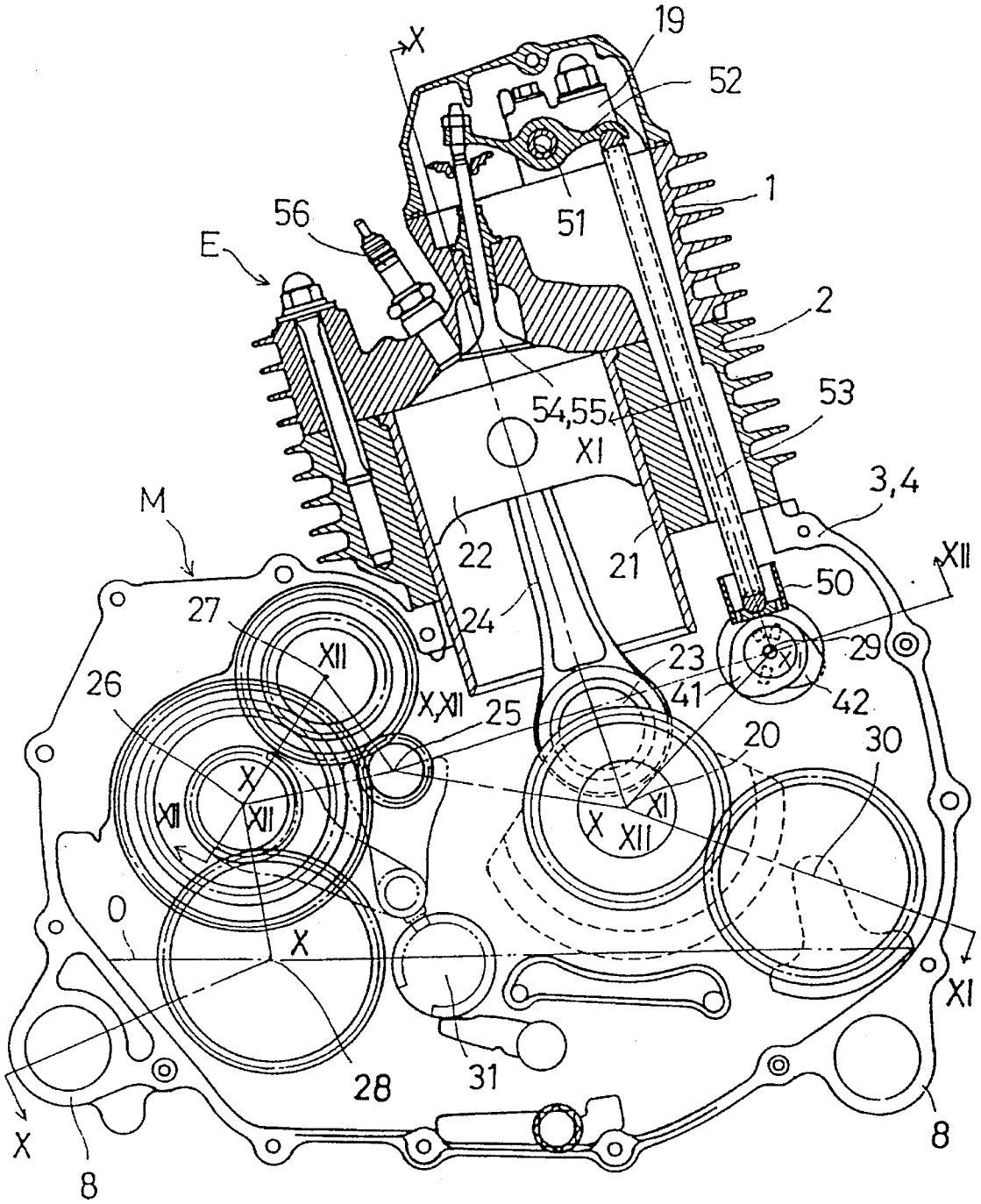
FIG. 5 is a rear view of a cylinder head and cylinder block in the state that a rear case cover is removed, with parts partially broken away.
Figure 6:
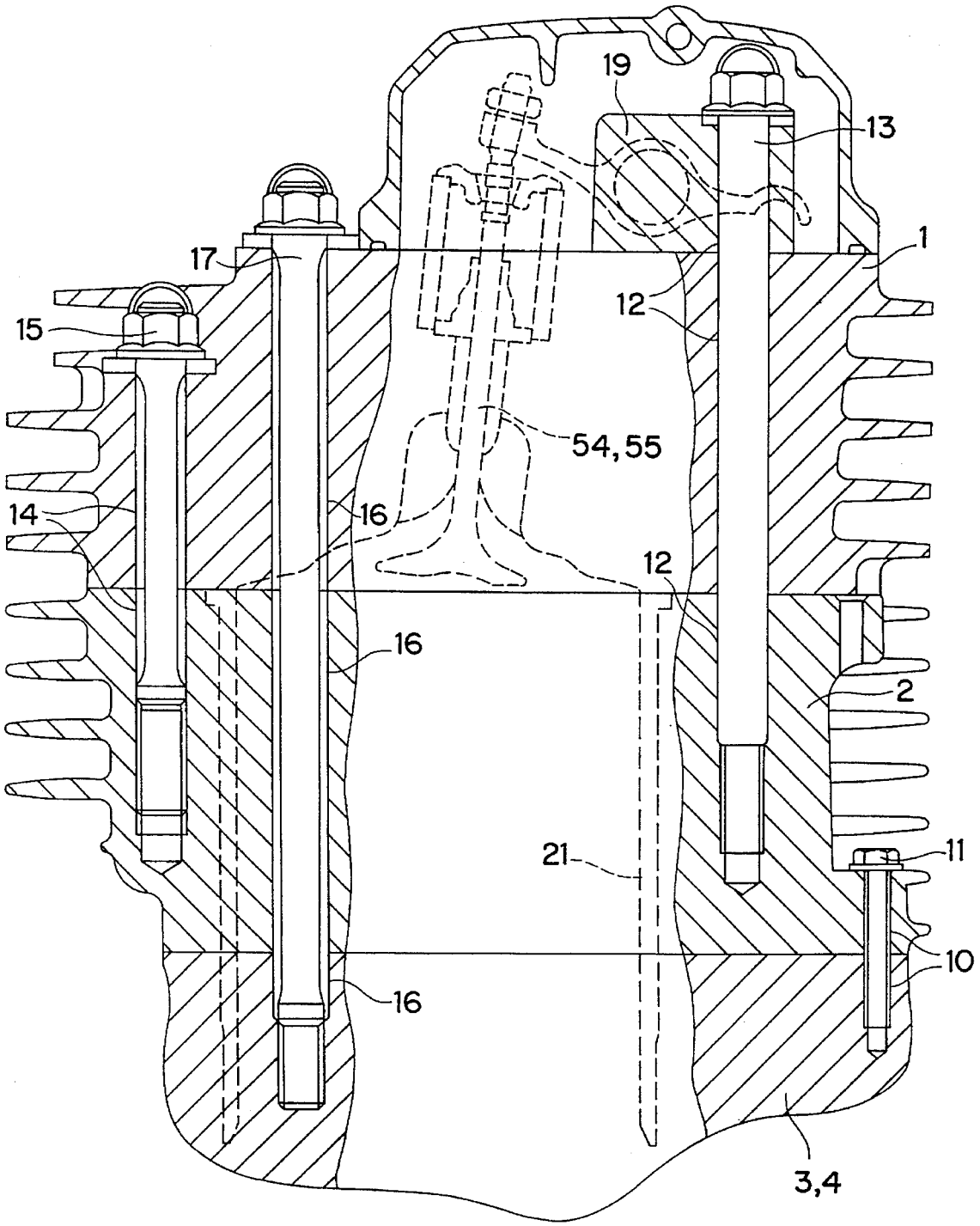
FIG. 6 is a vertical sectional view of an internal combustion engine taken along line VI—VI of FIG. 7.
Figure 7:
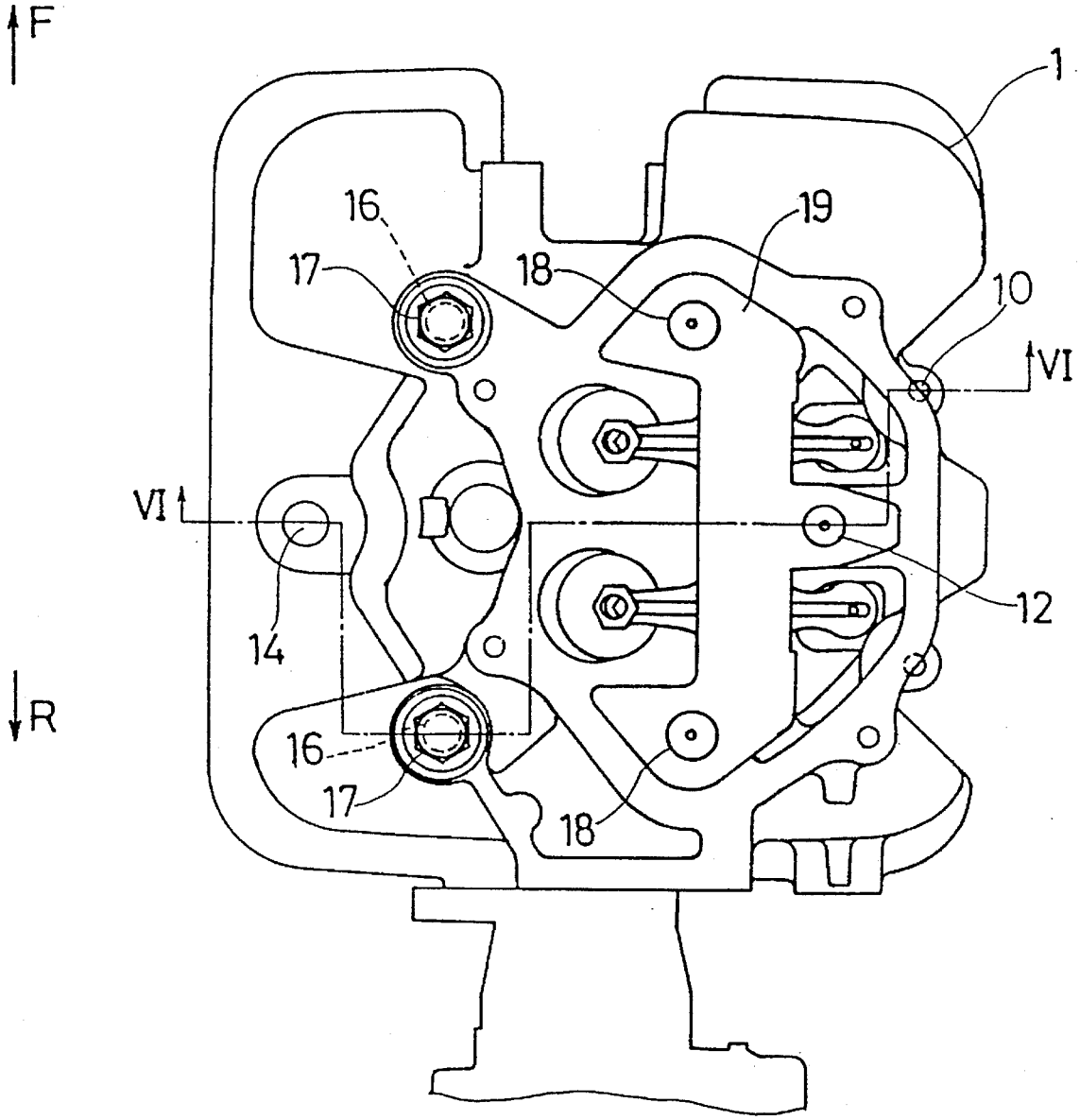
FIG. 7 is a plan view of the cylinder head.
Figure 8:
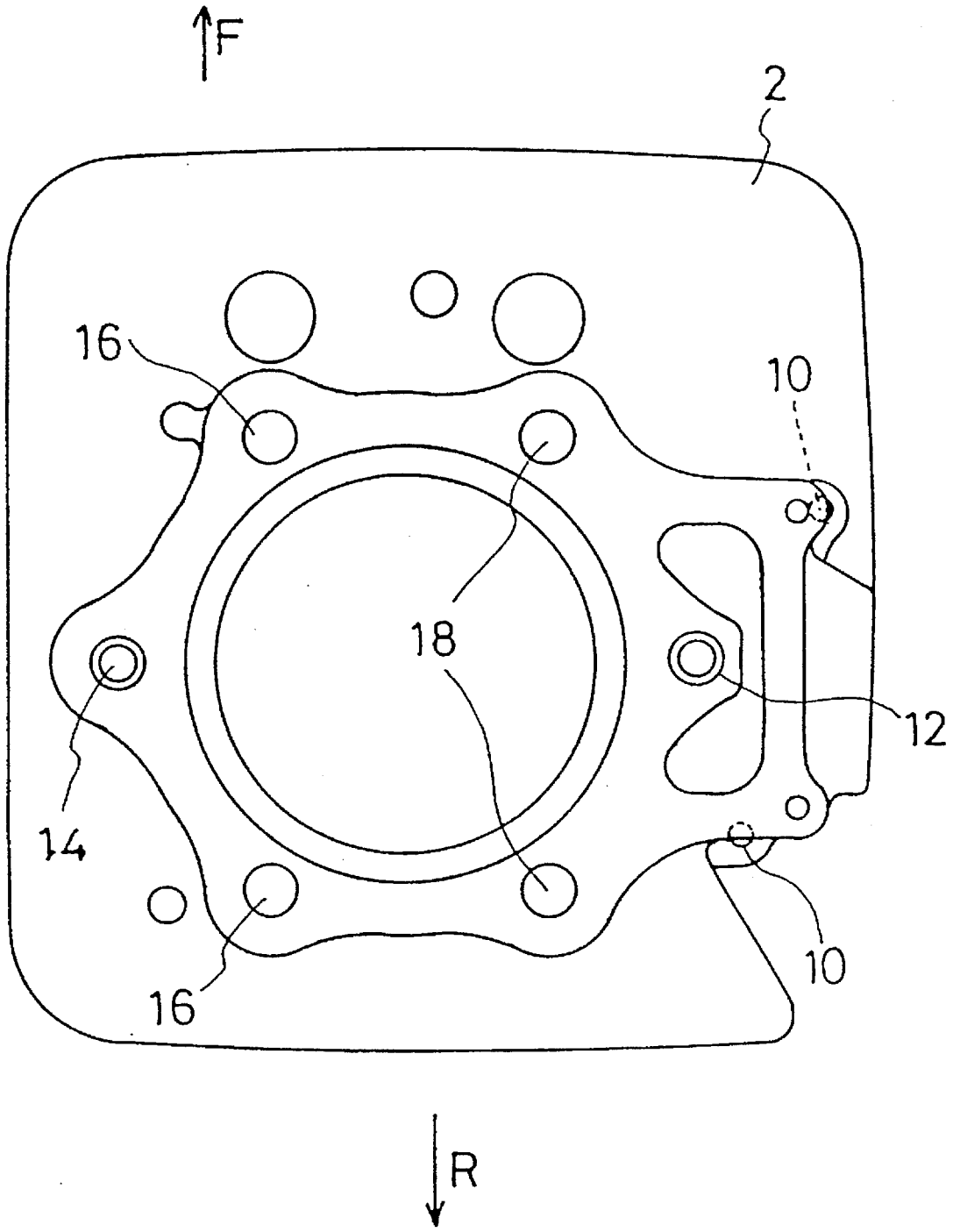
FIG. 8 is a plan view of the cylinder block.
Figure 9:
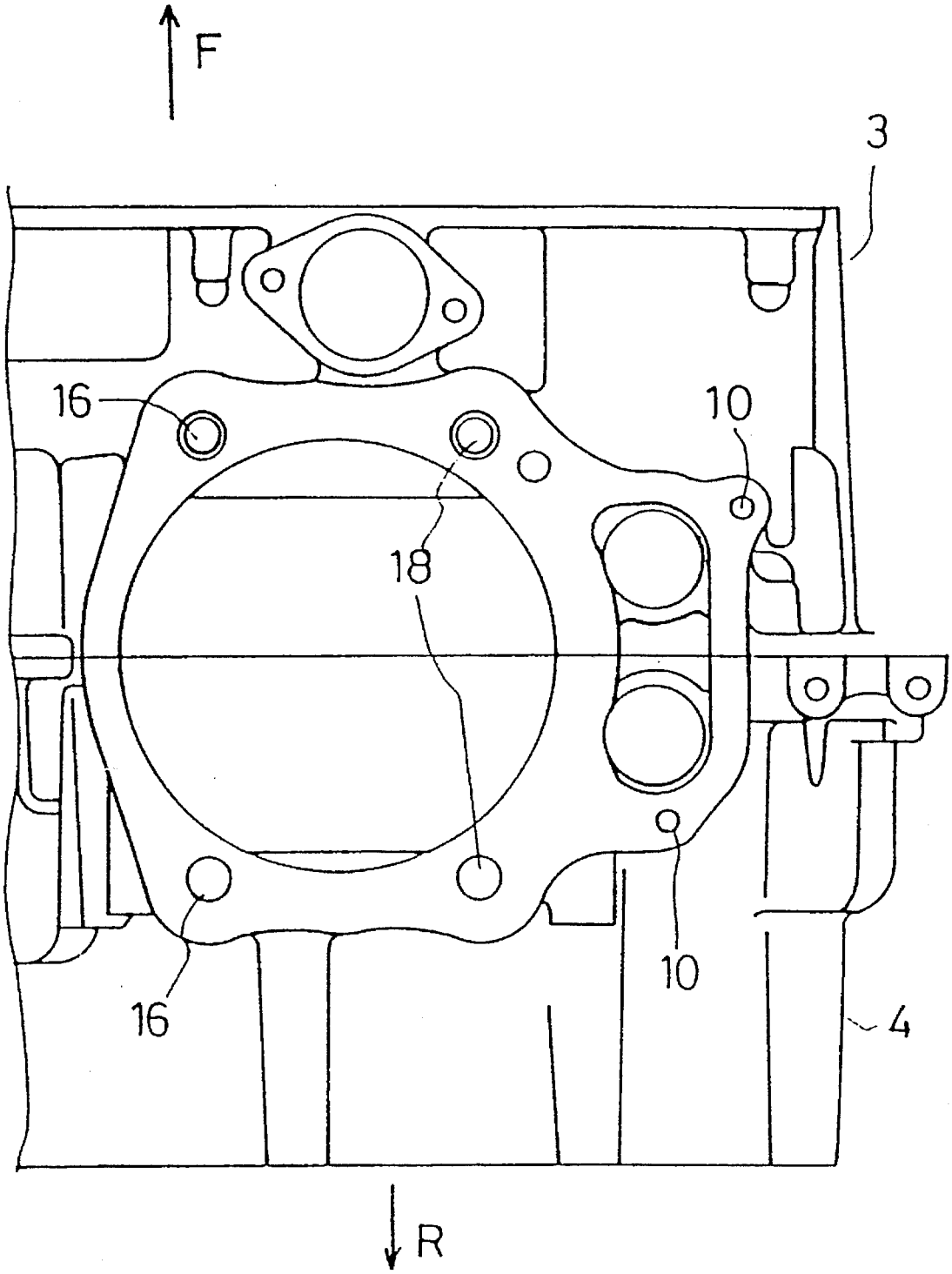
FIG. 9 is a plan view showing essential portions of the front crank case and rear crank case.

A crank shaft 20, extending in the operating direction of the vehicle A, is rotatably supported on the front and rear crank cases 3, 4 of the internal combustion engine E. As shown in FIG. 5, the crank shaft 20 is disposed so as to be slightly shifted rightward from the center of the front and rear crank cases 3, 4. The cylinder block 2 and the cylinder head 1 are tilted obliquely, leftward and upward from the crank shaft 20. A piston 22 slidably mounted in a cylinder 21 is connected to a crank pin 23 of the crank shaft 20 by means of a connecting rod 24. The crank shaft 20 is rotated by the vertical movement of the piston 22.

A main shaft 25 and a countershaft 26 of the transmission M are disposed in this order leftward from the crank shaft 20. A reverse shaft 27 is disposed over the intermediate portion between the main shaft 25 and the countershaft 26, and a drive shaft 28 is disposed under the countershaft 26. In such a state, the main shaft 25, countershaft 26, reverse shaft 27 and drive shaft 28 are rotatable supported by the front and rear crank cases 3, 4 while being disposed in parallel to the crank case 20.

A cam shaft 29 is disposed obliquely, rightward and upward from the crank shaft 20, and a balancer shaft 30 is disposed under the cam shaft 29. A shift drum 31 is disposed under the main shaft 25 and rightward from the drive shaft 28. In such a state, the cam shaft 29, balancer shaft 30 and shift drum 31 are rotatably supported by the front and rear crank cases 3, 4.

Figure 4:
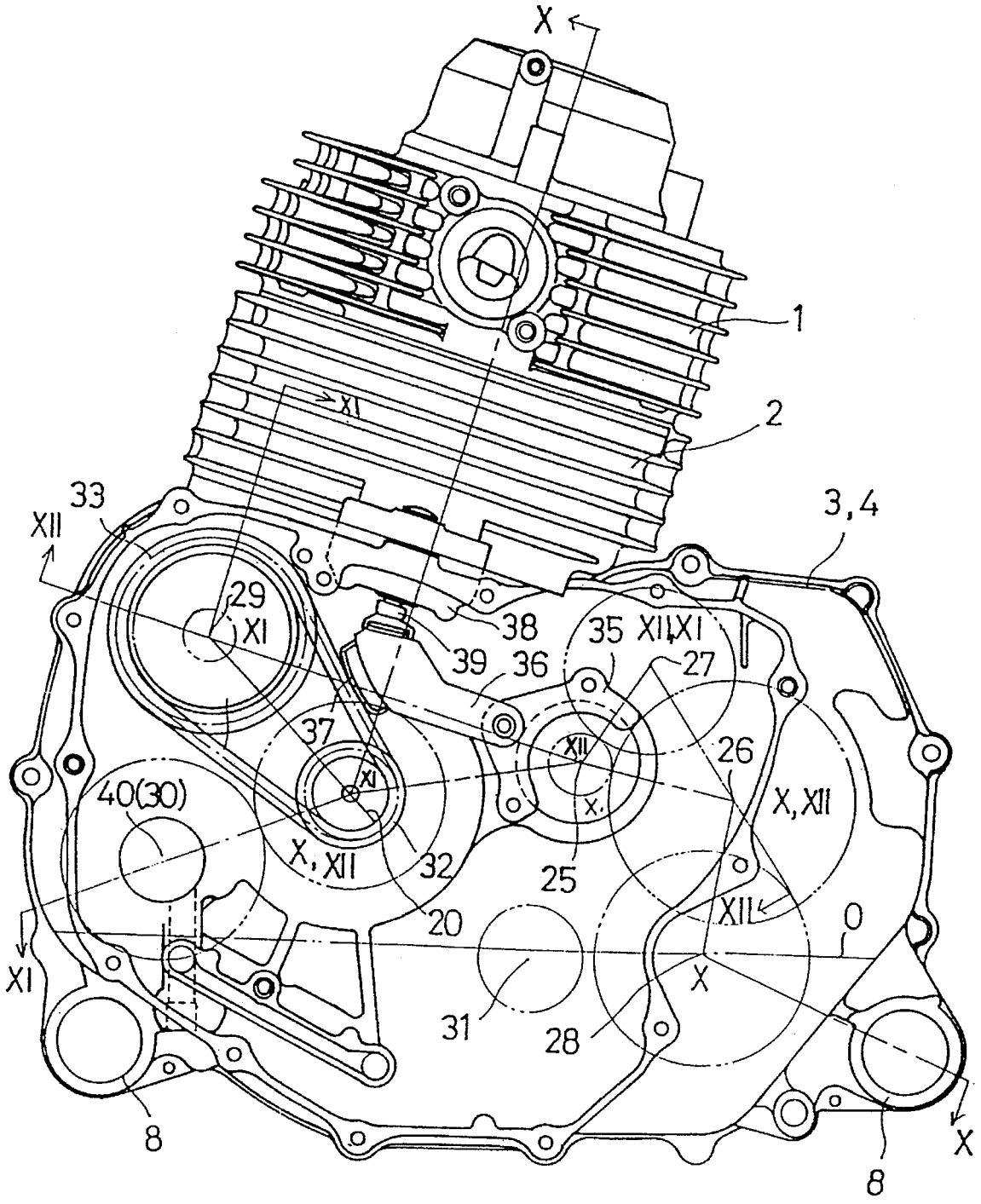
FIG. 4 is a front view of the power unit in which a front case cover is removed.

As shown in FIG. 4, sprockets 32, 33 are respectively provided on the crank case 20 and the cam shaft 29, and an endless chain 34 is hung between the sprockets 32, 33. When the crank shaft 20 is rotated, the cam shaft 29 is rotated at a speed reduction ratio of ½.

Figure 12:
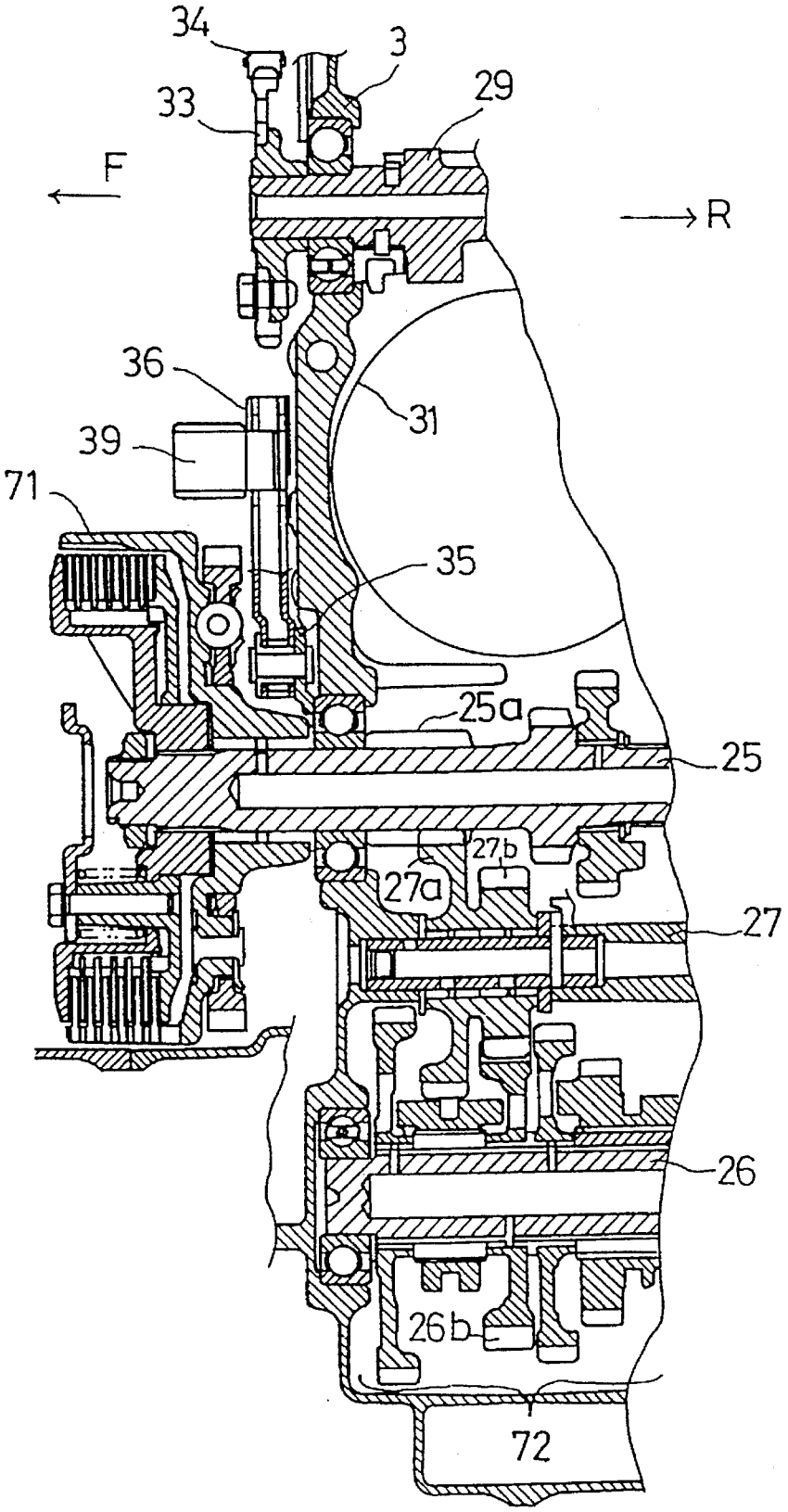
FIG. 12 is a vertical sectional view of the power unit taken along line XII—XII of FIG. 4.

The sprockets 32, 33 are disposed at positions projecting forward from the front crank case 3, and as shown in FIG. 4, the endless chain 34 is suitably stretched. Specifically, a chain tensioner 36 is vertically rockably provided on a bearing holder 35 of the main shaft 25, and a slipper 37 is provided on the lower surface of the leading end of the bearing holder 35. Moreover, as shown in FIG. 12, a pressing portion of an adjusting device 38 fitted from the upper side and mounted on the front crank case 3 by means of a bolt (not shown) is abutted on a receiving portion 39 projecting forward from the chain tensioner 36. The endless chain 34 is thus suitably stretched by means of the chain tensioner 36 biased by the pressing portion of the adjusting device 38.

Figure 11:
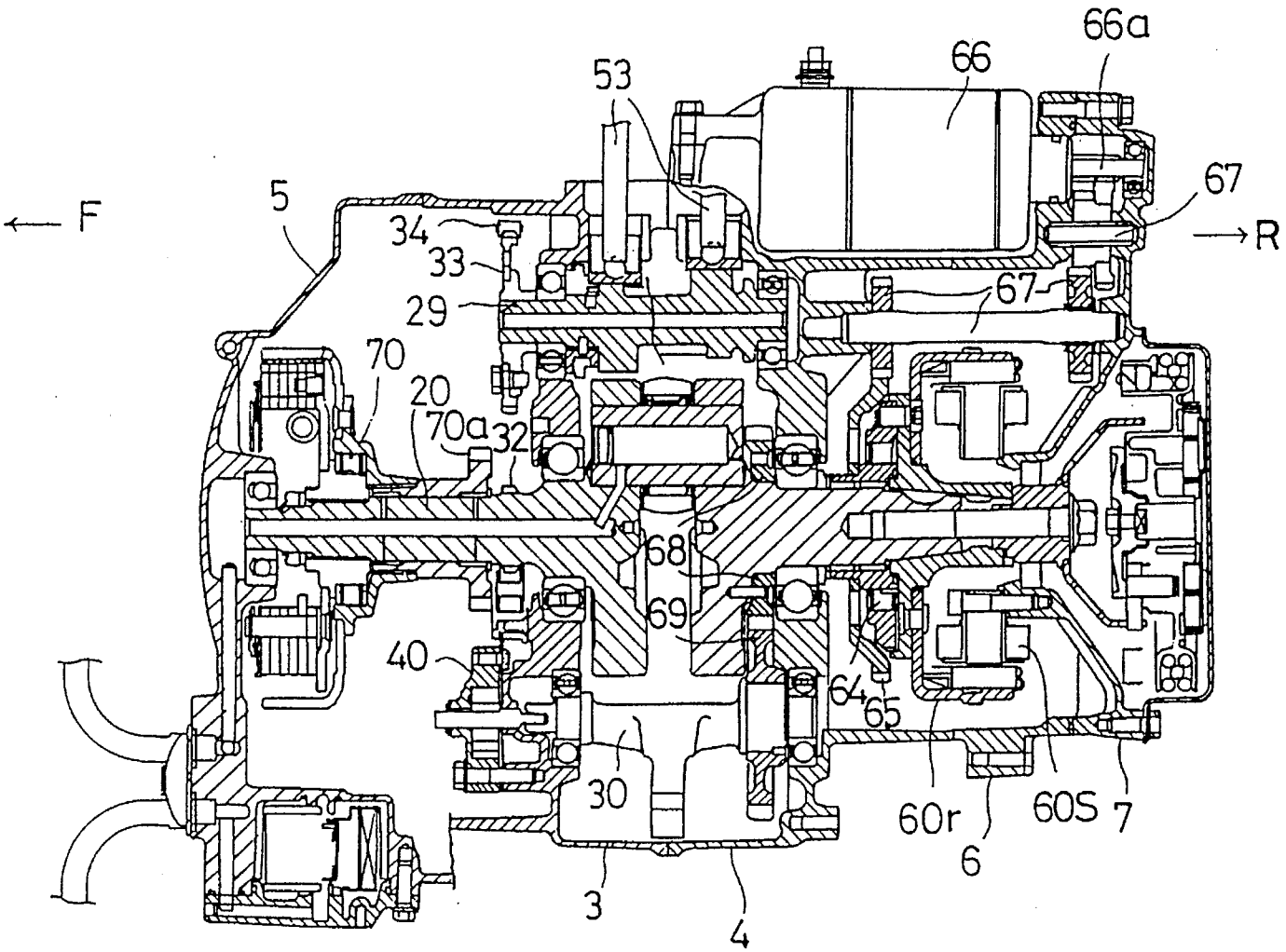
FIG. 11 is a vertical sectional view of the power unit taken along line XI—XI of FIG. 5.

As shown in FIG. 11, a hydraulic pump 40 is disposed in front of the balancer shaft 30, and the rotational shaft of the hydraulic pump 40 is directly connected to the balancer shaft 30. When the internal combustion engine E is operated, the hydraulic pump 40 is rotated together with the balancer shaft 30 for supplying lubricating oil to portions to be lubricated in the internal combustion engine E and the transmission M.

Figure 13:
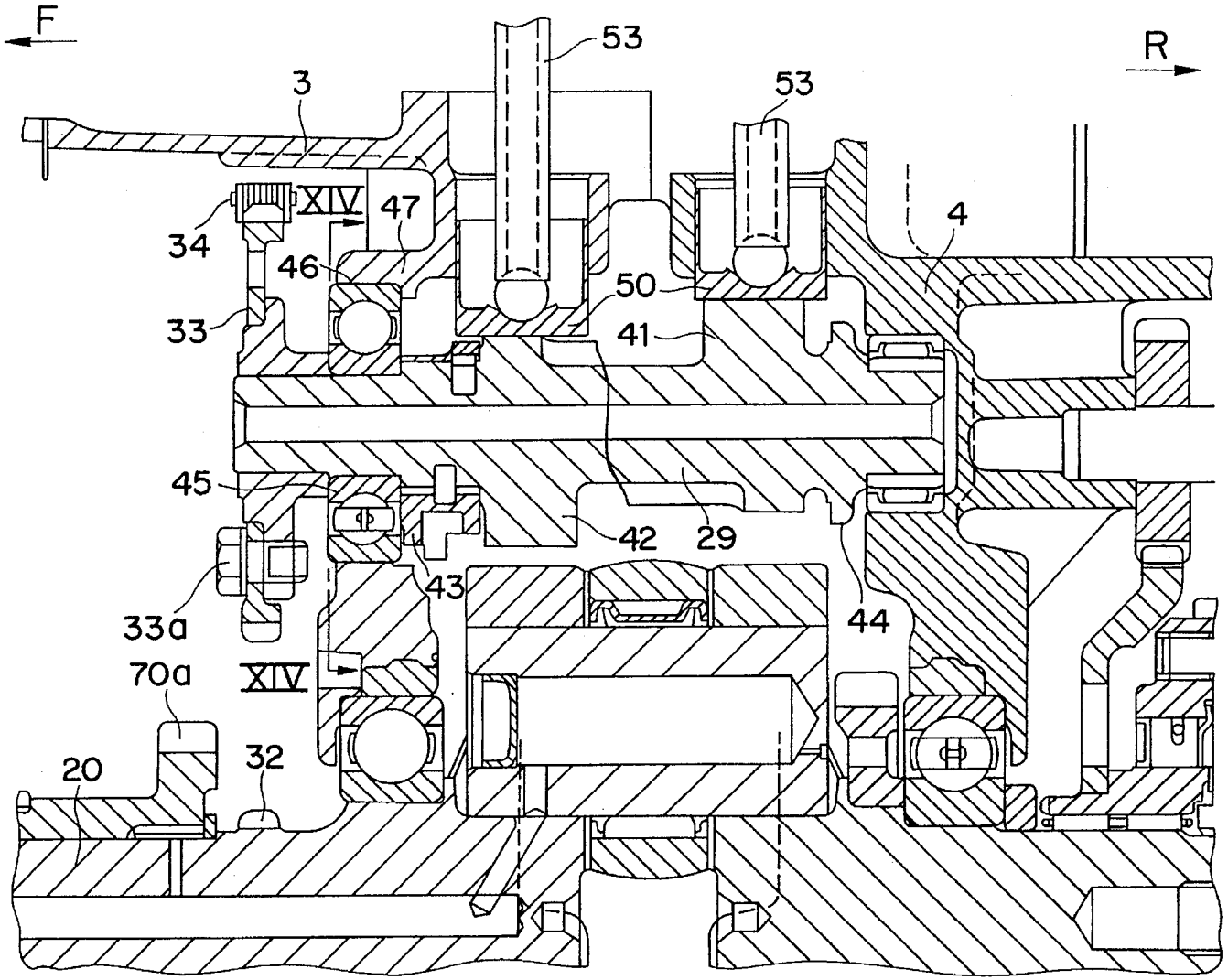
FIG. 13 is an enlarged vertical sectional view showing an essential portion of FIG. 11.
Figure 14:
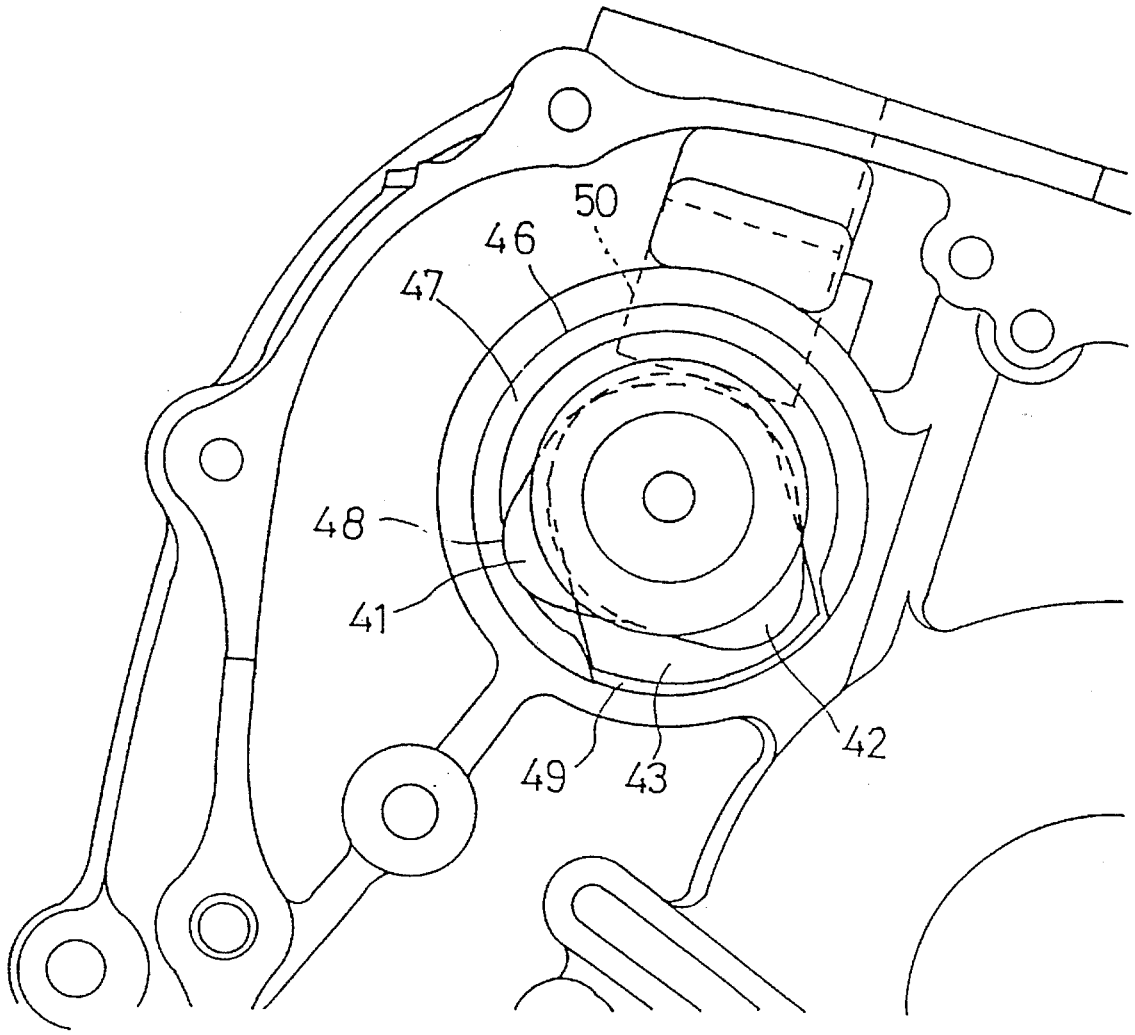
FIG. 14 is a sectional view taken along line XIV—XIV of FIG. 13.

As shown in FIGS. 11 and 13, an intake cam 41 and an exhaust cam 42 are formed integrally with the cam shaft 29, and a decompression cam 43 is additionally provided adjacent to the front side of the exhaust cam 42. A rib 44 is formed in back of the intake cam 41. A cylindrical surface portion 46, having a diameter being the same as that of the outer periphery surface of a ball bearing 45 for supporting the front portion of the cam shaft 29 and being larger than the diameter of the base circle of the cam shaft 29, is formed on the front crank case 3. A locking stepped portion 47 is formed in back of the cylindrical surface portion 46. Cutout portions 48 are formed in the locking stepped portion 47 so that the cam shaft 29 can be pulled forward in the state that the intake cam 41, exhaust cam 42 and the decompression cam 43 are arranged as shown in FIG. 14.

Tappets 50 are vertically movably fitted in the front and rear crank cases 3, 4 at the positions over the intake cam 41 and the exhaust cam 42. As shown in FIG. 5, a push rod 53 is interposed between the right end of a rocker arm 52 rockably supported on the rocker arm holder 19 through a rocker shaft 51 and the tappet 50. The rocker arm 52 is vertically rocked in accordance with the rotation of the cam shaft 29 for opening/closing each of an intake valve 54 and an exhaust valve 55 positioned rightward from the center of the cylinder 21 and abutted on the left end of the rocker shaft 51.

An ignition plug 56 is mounted in such a manner as be tilted leftward from the center line of the cylinder 21.

A carburetor 59 is connected to an intake passage 57 provided with the intake valve 54, and an exhaust pipe (not shown) is connected to an exhaust passage 58 provided with the exhaust valve 55.

Figure 10:
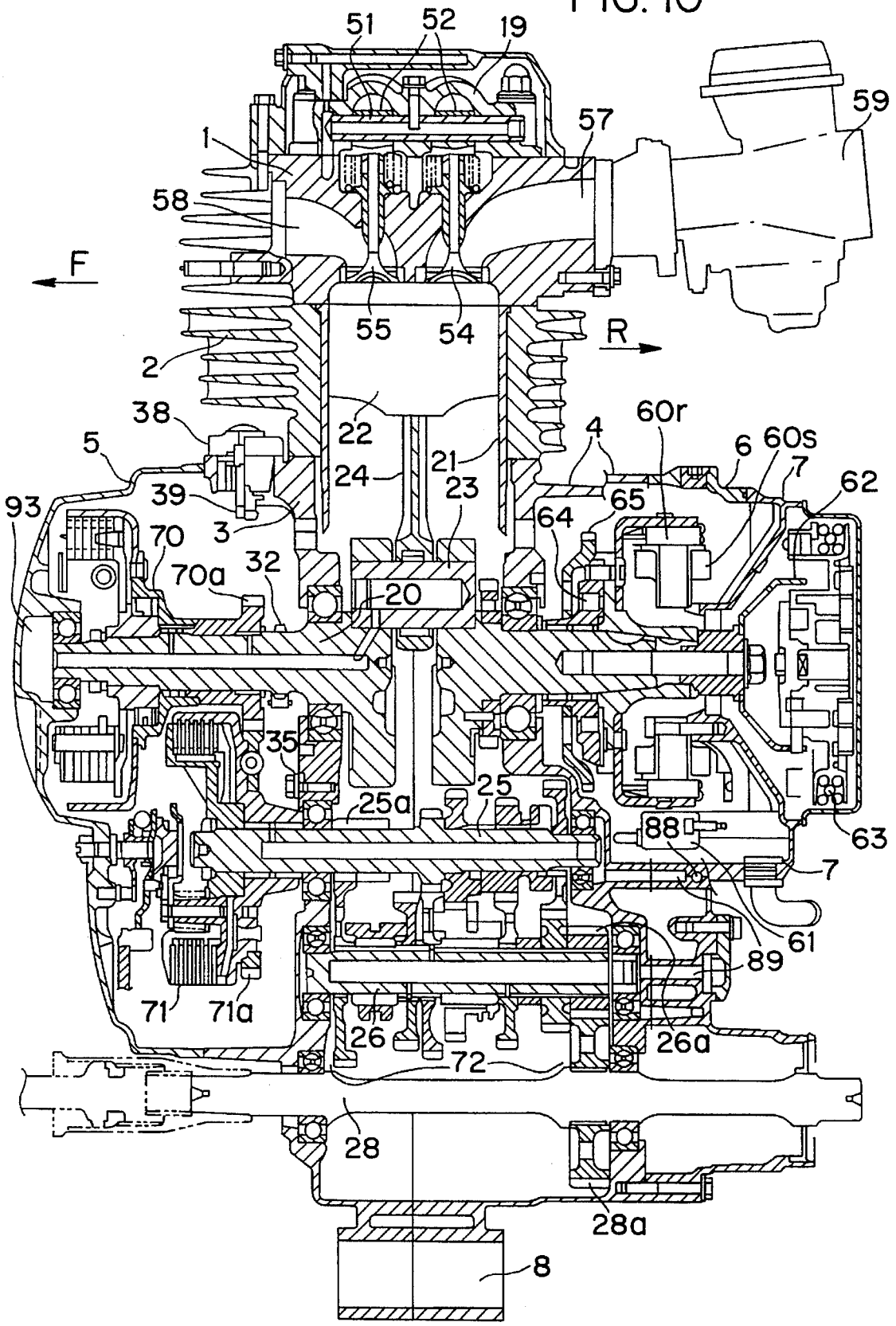
FIG. 10 is a vertical sectional view of the power unit taken along line X—X of FIG. 4.

A rotor 60*r* of an ACG 60 is mounted on the rear portion of the crank shaft 20, and an ACG cover 7 is removably mounted on the rear case cover 6 mounted on the rear crank case 4. A stator 60*s* of the ACG 60 is mounted on the ACG cover 7, and as shown in FIG. 10, the ACG 60 and other electrical equipment are mounted on the ACG cover 7. By removing the ACG cover, the stator 60*s* of the ACG 60, a pulser 61 and the other electrical equipment can be removed together with the ACG cover 7.

A starting wheel 62 is mounted on the rear end of the crank shaft 20, and a recoil starter 63 is provided in such a manner as to face to the starting wheel 62. The internal combustion engine E can be started by manually operating the recoil starter 63.

As shown in FIG. 11, a starting gear 65 is positioned in front of the rotor 60*r* of the ACG 60 and is freely fitted around the crank shaft 20 through a one-way clutch 64. An output shaft 66*a* of a starter motor 66 mounted on the rear crank case 4 is connected to the starting gear 65 through a reduction gear unit 67. When the starter motor 66 is rotated, the crank shaft 20 is rotated through the reduction gear unit 67, starting gear 65 and one-way clutch 64, thus automatically starting the internal combustion engine E.

A centrifugal type starting clutch 70 is provided on the front end of the crank shaft 20, and a multi-disc type gear shift clutch 71 is provided on the front end of the main shaft 25. An output gear 70*a* of the centrifugal type starting clutch 70 is meshed with an input gear 71*a* of the multi-disc type gear shift clutch 71. In the case where the crank shaft 20 is stopped or rotated at a rotational speed less than a specified value, the centrifugal type starting clutch 70 is in the cut-off state. While in the case where it is rotated at a rotational speed more than the specified value, the centrifugal type starting clutch 70 is connected to the multi-disc type gear shift clutch 71.

As shown in FIG. 10, a multi-stage speed change gear train 72 is interposed between the main shaft 25 and the countershaft 26. The output gear 26*a* of the countershaft 26 is meshed with the input gear 28*a* of the drive shaft 28. As shown in FIG. 12, the output gear 25*a* of the main shaft 25 is meshed with the input gear 27*a* of the reverse shaft 27. The output gear 27*b* of the reverse shaft 27 is meshed with the reverse input gear 26*b* of the countershaft 26. When the change pedal near the left step D is shifted at a specified speed change position or reverse position, the multi-disc gear shift clutch 71 is cut-off only upon this operation, and the multi-stage speed change gear train 72 and the reverse input gear 26*b* of the countershaft 26 are switched, so that the countershaft 26 is rotated at a specified gear shift ratio or normal/reverse state.

Figure 15:
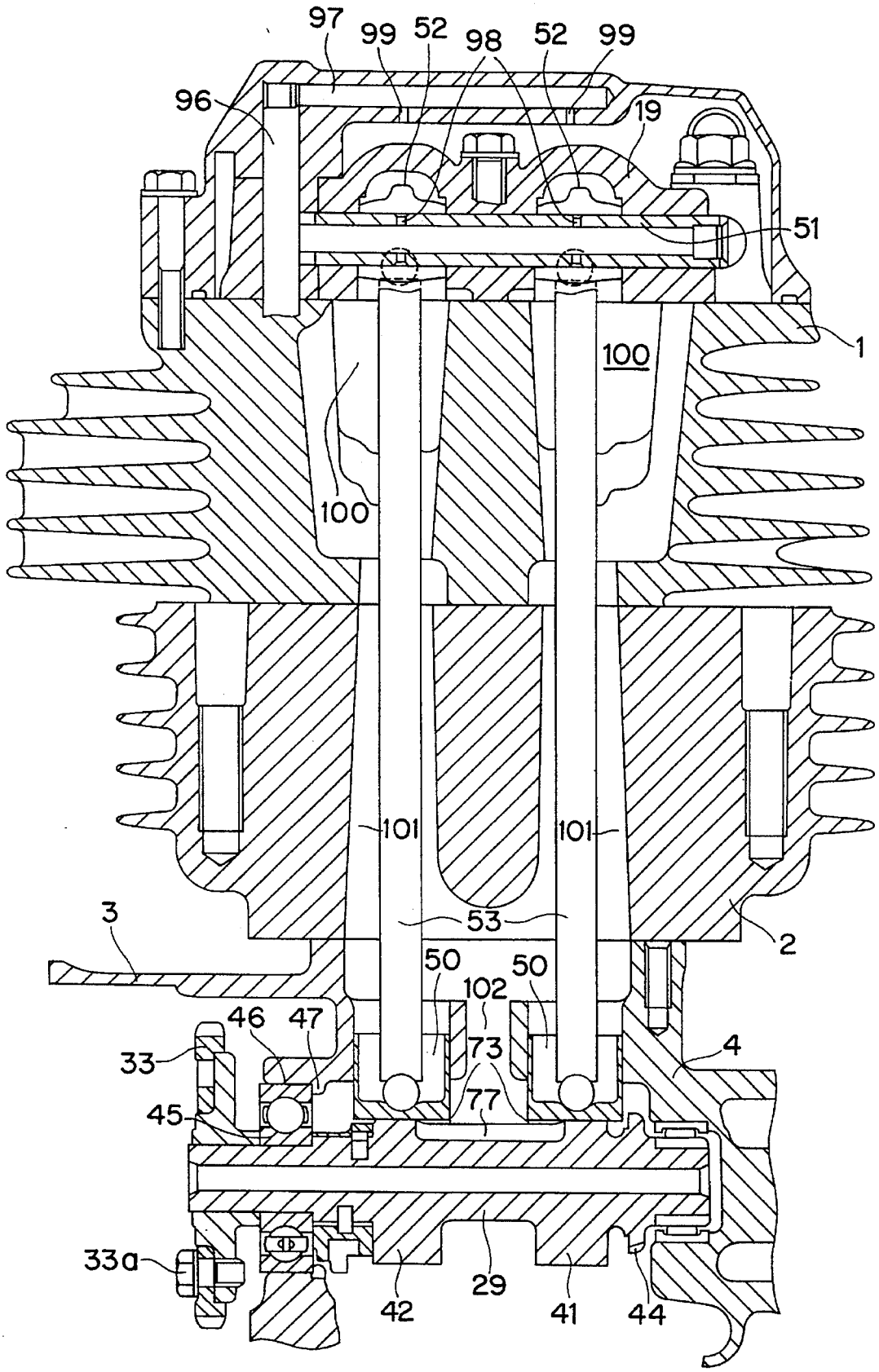
FIG. 15 is a vertical sectional view taken along line XV—XV of FIG. 13.
Figure 16:
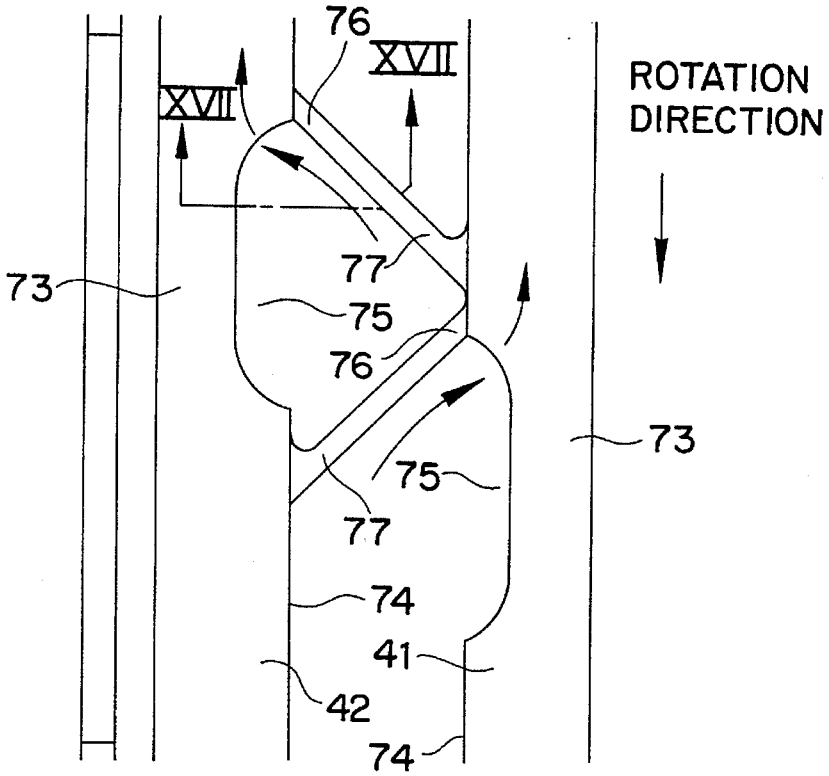
FIG. 16 is a development of the surfaces of intake and exhaust cams.
Figure 17:
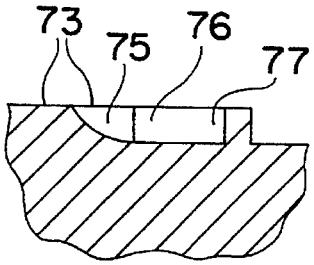
FIG. 17 is a sectional view taken along line XVII—XVII of FIG. 16.

As shown in FIGS. 15 to 17, recessed portions 75 extending in the direction of the cam shaft 29 from the opposed edges 74 of the intake cam 41 and the exhaust cam 42 are respectively formed on the base circles 73 of the intake cam 41 and the exhaust cam 42 of the cam shaft 29. Moreover, projecting ribs 77 crossing the a predetermined circumference of the cam shaft 29, having rib end portions 76 directed toward the recessed portions 75, and extending in the rotational direction of the cam shaft 29, radially project from the cam shaft 29 adjacent to the recessed portions 75.

Figure 18:
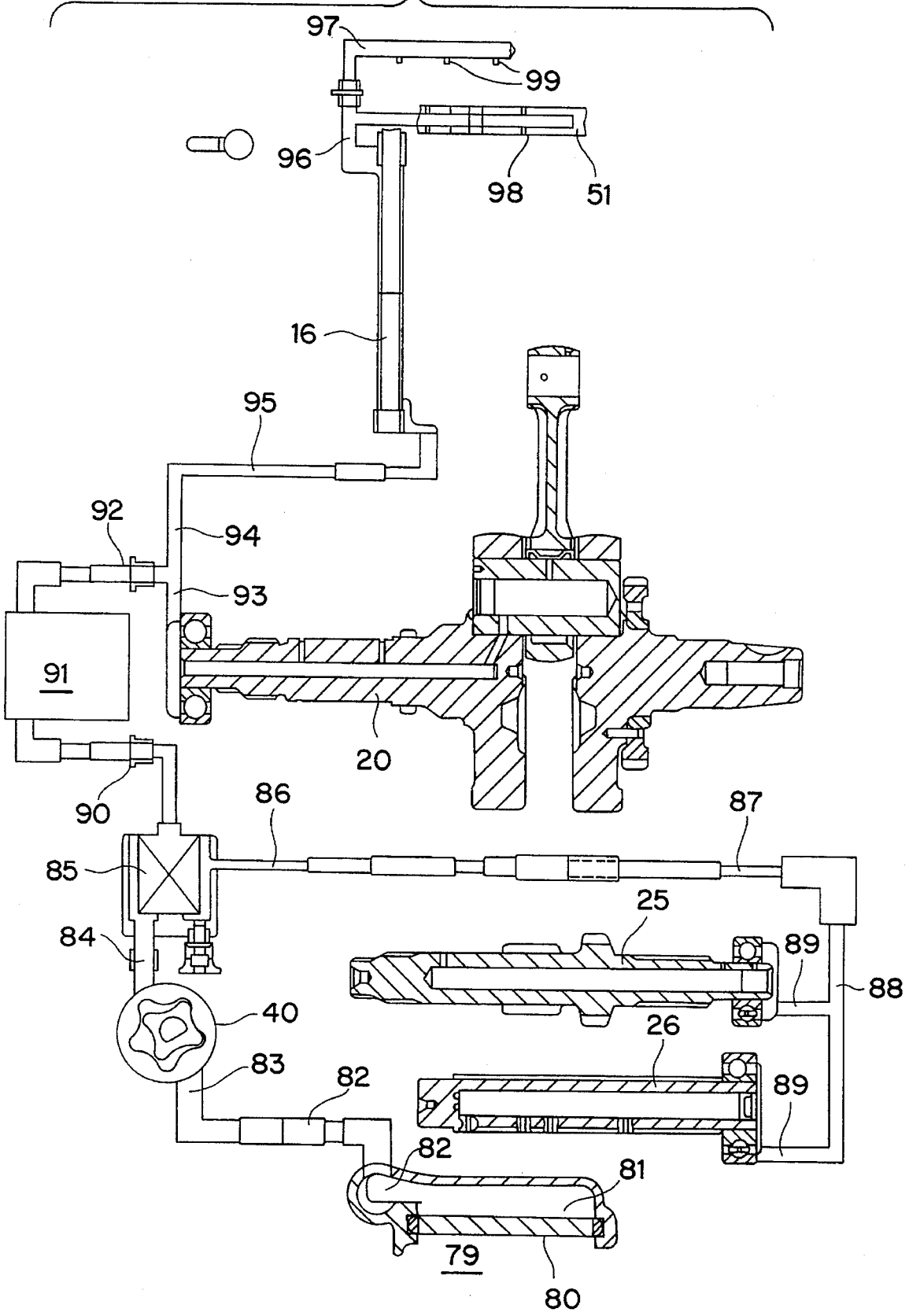
FIG. 18 is a view showing a lubricating system.
Figure 19:
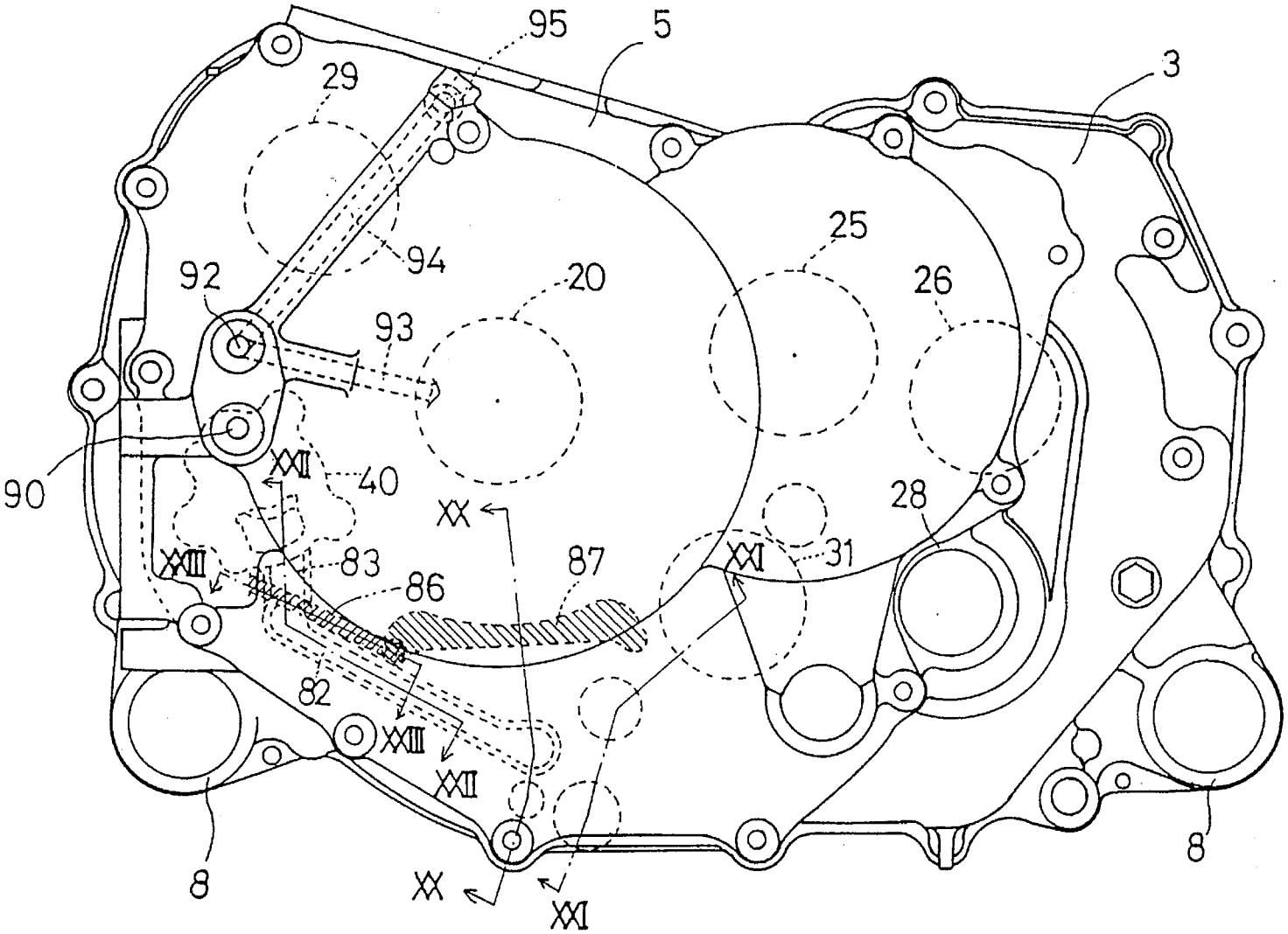
FIG. 19 is a front view of the front case cover and front crank case.
Figure 20:
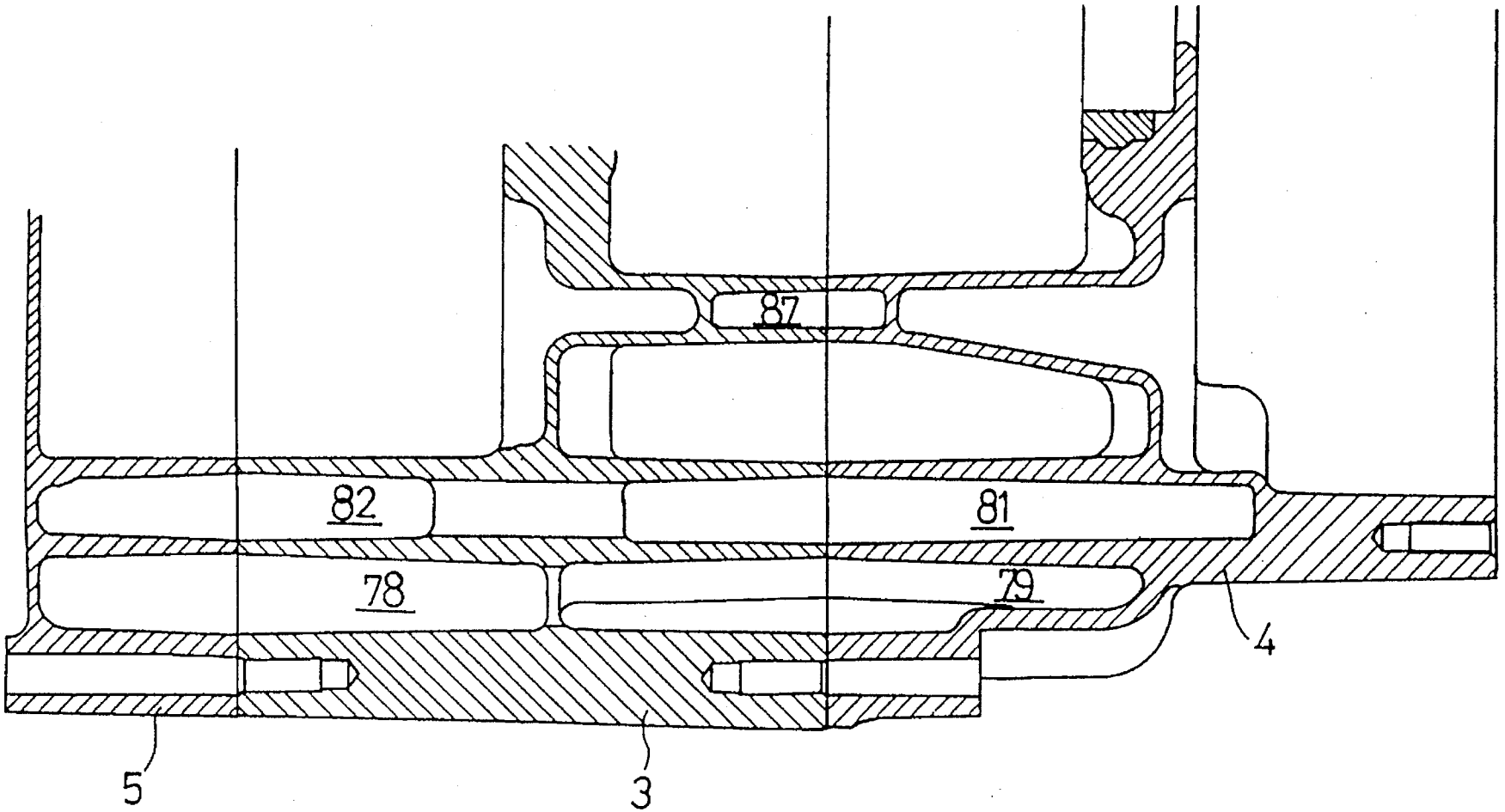
FIG. 20 is a sectional view taken along line XX—XX of FIG. 19.
Figure 21:
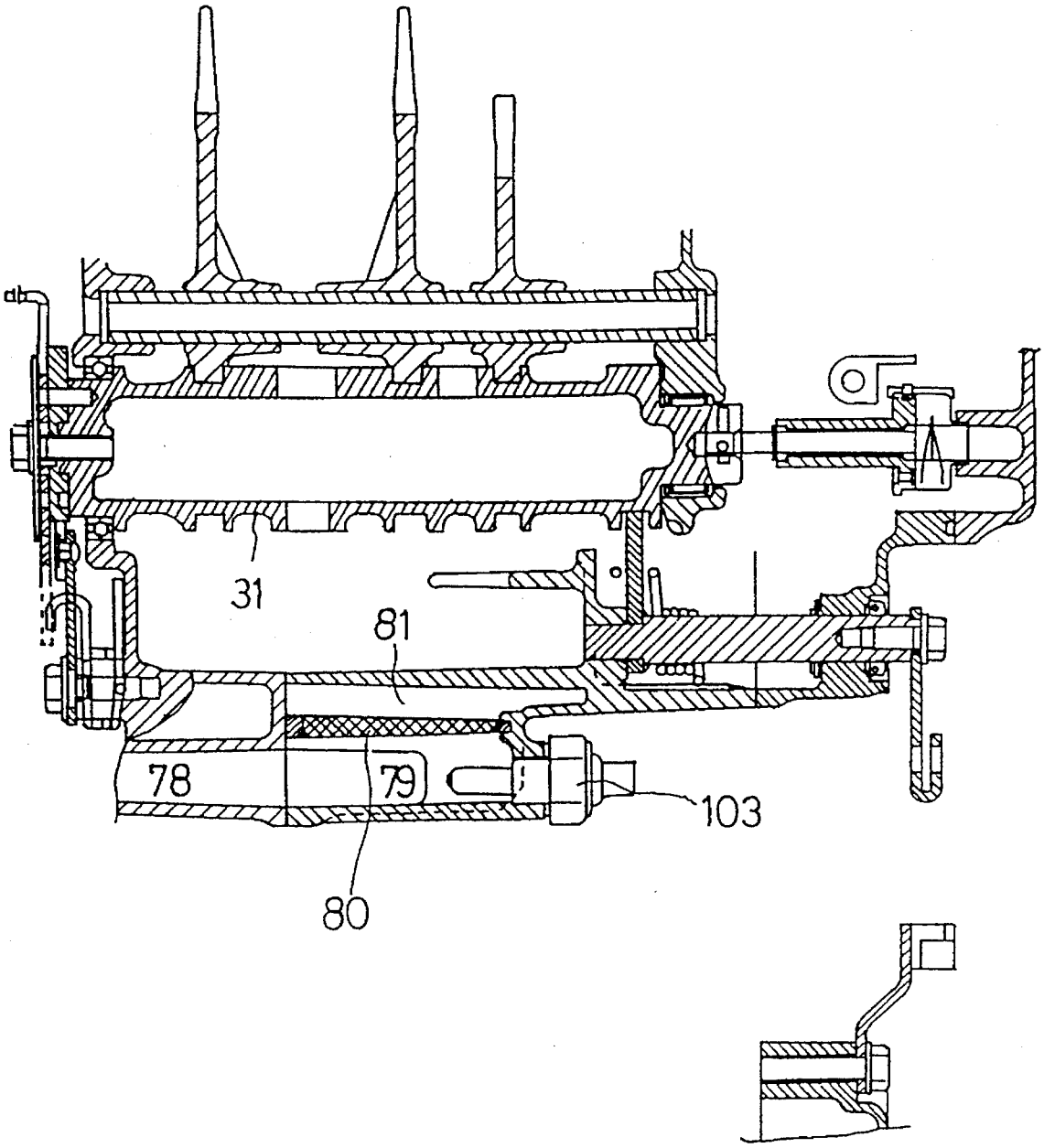
FIG. 21 is a sectional view taken along line XXI—XXI of FIG. 19.
Figure 22:
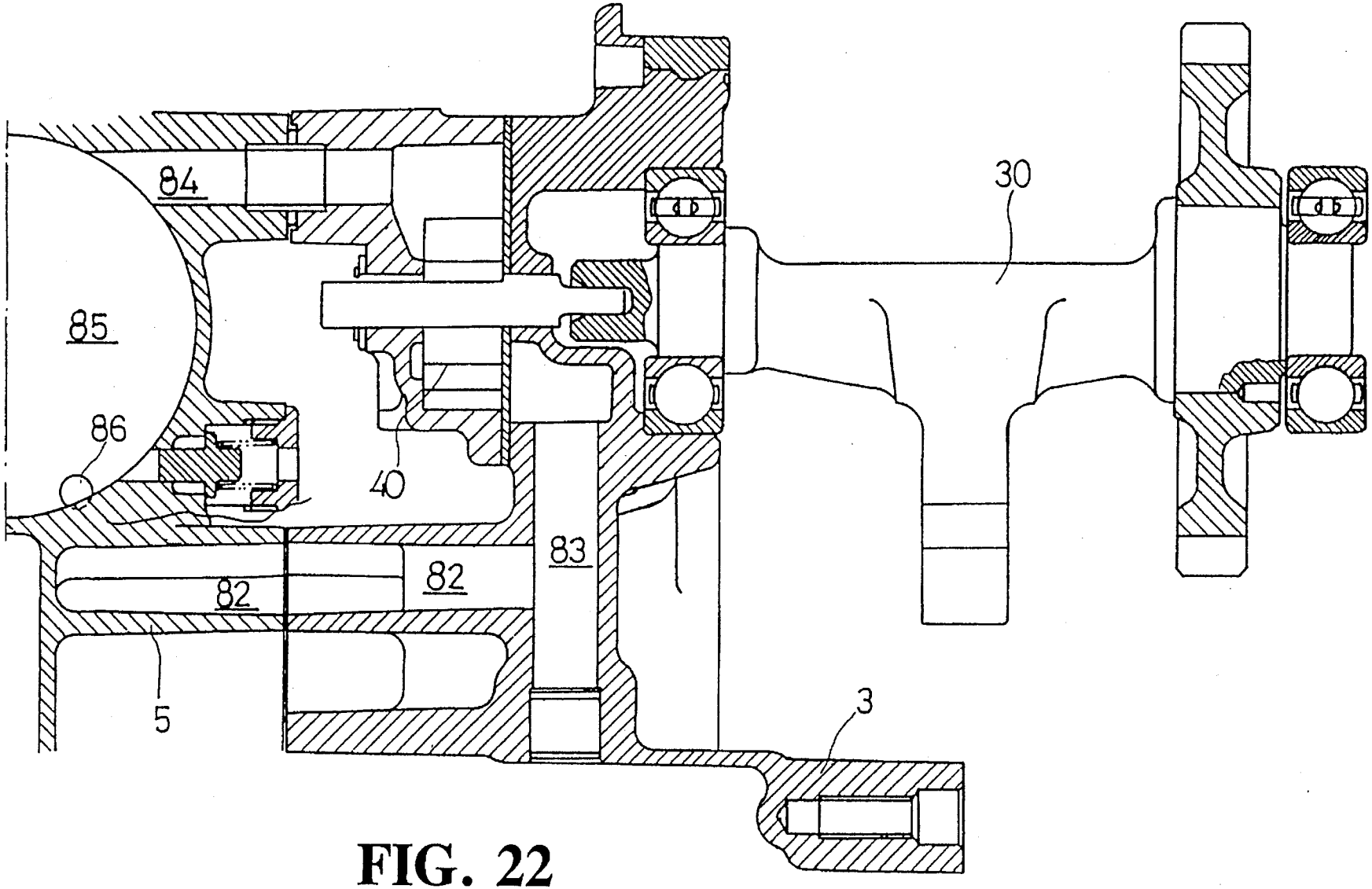
FIG. 22 is a sectional view taken along line XXII—XXII of FIG. 19.
Figure 23:
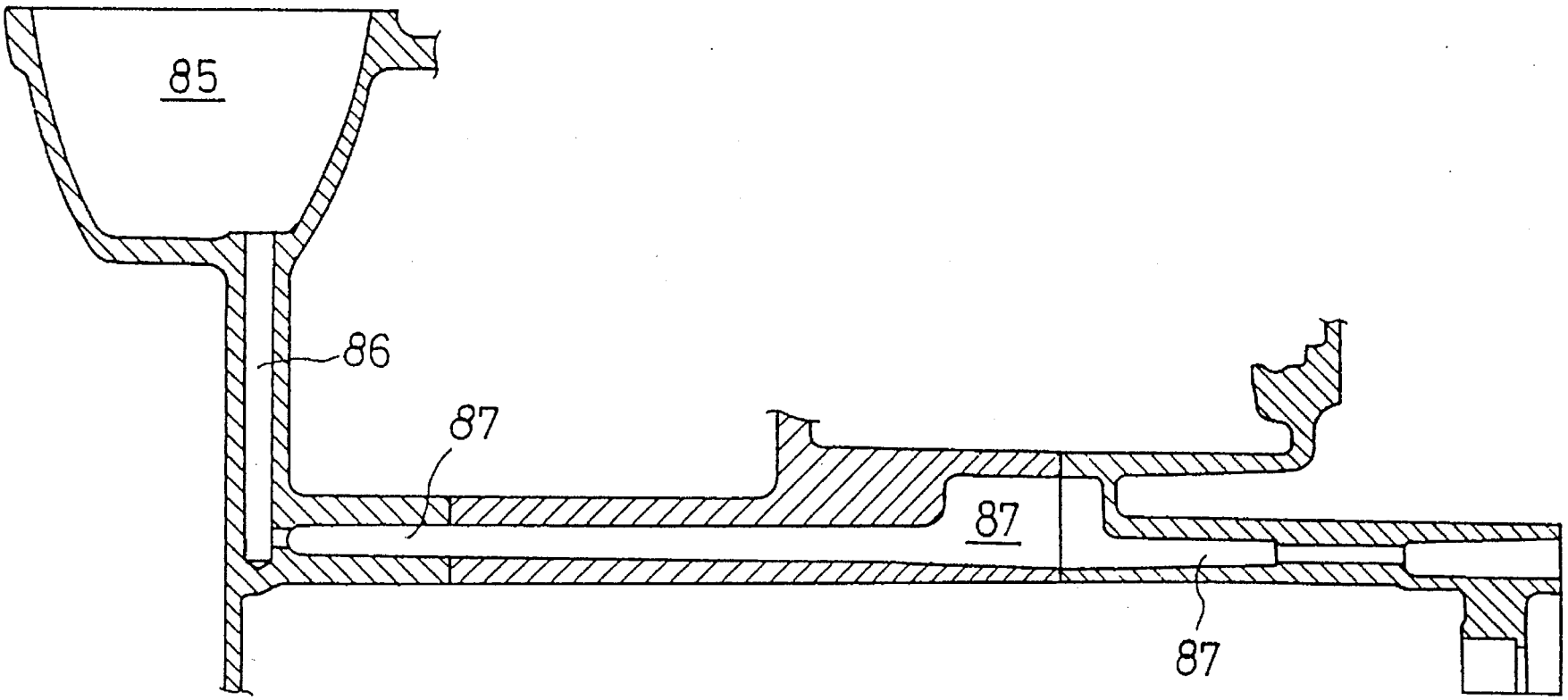
FIG. 23 is a sectional view taken along line XXIII—XXIII of FIG. 19.

Referring to FIGS. 18 to 23, the outline of a lubricating system of the power unit P will be described. A lubricating oil reservoir 79 of the rear crank case 4 communicates with a lubricating oil reservoir 78 of the front crank case 3 as shown in FIG. 20. As illustrated in FIG. 21, partitioned into upper and lower parts by means of an approximately horizontal strainer 80 disposed nearly at the center of the front and rear crank cases 3, 4. Of the upper and lower parts of the lubricating oil. reservoir 79, the upper lubricating oil passage 81 is, as shown in FIGS. 20 and 22 in communication with a lubricating oil passage 82 formed in the front crank case 3 and the front crank case cover 5. The lubricating oil passage 82 is connected to a suction port of the hydraulic pump 40 through a lubricating oil passage 83 extending in the direction perpendicular to the lubricating oil passage 82. A discharge port of the hydraulic pump 40 is connected to an oil filter 85 through a lubricating oil passage 84.

Part of the lubricating oil filtered by the oil filter 85 is allowed to flow from a lubricating oil passage 86 parallel to the lubricating oil passage 82 into lubricating oil passages 88, 89, see FIG. 10, provided in the rear case cover 6 through a lubricating oil passage 87 extending in the direction perpendicular to the front case cover 5, front crank case 3, and rear crank case 4, thus lubricating the main shaft 25 and the countershaft 26.

The remainder of the lubricating oil filtered by the oil filter 85 is supplied from a discharge port 90 of the front case cover 5 shown in FIG. 19 into a cooler 91, shown only in FIG. 18, and the lubricating oil cooled at the cooler 91 is, as shown in FIG. 19, supplied from a suction port 92 of the front case cover 5 into the crank shaft 20 through a lubricating oil passage 93.

A lubricating oil passage 94 branched obliquely and upward from the lubricating oil passage 93 is connected to the bolt holes 16 of the front crank case 3 through a lubricating oil passage 95 extending in the direction perpendicular to the lubricating oil passage 94. The bolt holes 16 are connected to a lubricating oil passage 96 shown in FIG. 15. The lubricating oil passage 96 is connected to the rocker shaft 51 and a lubricating oil passage 97, so that the lubricating oil is supplied from a lubricating oil hole 98 of the rocker shaft 51 to a sliding portion between the rocker shaft 51 and the rocker arm 72, and the lubricating oil is also discharged from a lubricating oil hole 99 of the lubricating oil passage 97, thus lubricating the valve system. In addition, an oil temperature sensor 103 is provided in back of the lubricating oil reservoir 79.

In the embodiment shown in FIGS. 1 to 14 having the above-described construction, when a driver sitting astride the seat S puts his feet on the steps D and starts the internal combustion engine E by means of the starter motor 66 or recoil starter 63, and operates a throttle lever provided under the right grip of the steering handle H, the carburetor 59 is opened and the internal combustion engine E to accelerated, and when the crank shaft 20 is rotated at a rotational speed over a specified value, the centrifugal type starting clutch 70 is automatically connected, thus operating the off-road running saddle type vehicle A.

Since the crank shaft 20, main shaft 25, countershaft 26, reverse shaft 27 and drive shaft 28 all extend in the operating direction of the vehicle A, it becomes possible to transmit the power of the internal combustion engine E to a front wheel differential gear Gf and a rear wheel drive gear Gr of the front wheels Wf and the rear wheels Wr only using the minimum number of bevel gears, and hence to reduce the weight of the power transmission system.

In the power unit P, the upper portion of the crank shaft 20 is tilted leftward and the lower portion of the crank shaft 20 is shifted slightly rightward from the center of the front and rear crank cases 3, 4. The main shaft 25, countershaft 26, reverse shaft 27, drive shaft 28 and shift drum 31 of the transmission M are disposed leftward from the crank shaft 20. The cam shaft 29, balancer shaft 30, hydraulic pump 40, starter motor 66, tappets 50 of the valve system, rocker shaft 51, rocker arm 52 and push rod 53 are disposed rightward from the crank shaft 20. With this construction, the height of the front and rear crank cases 3, 4 can be lowered while suppressing the lateral width of the front and rear crank cases 3, 4, thus reducing the size of the power unit P. Moreover, the front shape of the power unit P can be made substantially into an isosceles triangle, to lower the center of gravity of the power unit P. In addition, since the power unit P is not positioned near the inside of the thighs of a driver, the driver can sit at ease astride the seat S positioned over the power unit P.

Since the cylinder 21 is tilted leftward and the ignition plug 56 is also tilted leftward from the center of the cylinder 21, the ignition plug 56 can be easily exchanged without obstruction by the fuel tank T and the seat S positioned over the cylinder 21.

The crank shaft 20 is tilted leftward, the cam shaft 29 is disposed rightward and upward from the crank shaft 20, and the push rod 53 is disposed rightward from the cylinder 21. Accordingly, as compared with the case where the push rod is disposed over the crank shaft, the dimension of the internal combustion engine E in the direction of the crank shaft is reduced, to thereby shorten the whole longitudinal length of the power unit P, and the length of the push rod 53 is shortened, to thereby reduce the weight of the reciprocating portion of the valve system.

Since the balancer shaft 30 is positioned under the cam shaft 29 and the hydraulic pump 40 is disposed along the axial line of the balancer shaft 30, the height of the hydraulic pump 40 relative to a lubricating oil 0 can be lowered, to reduce the suction height of the hydraulic pump 40, thus smoothly performing the suction of the 35 lubricating oil.

Since the cylinder head 1, cylinder block 2, front crank case 3, rear crank case 4 and rocker arm holder 19 are connected to each other as shown in FIGS. 6 to 9, they can be forcibly integrated with each other. Also the cylinder head 1, cylinder block 2 and the rocker arm holder 19 are connected to each other and can be easily removed from the front and rear crank cases 3, 4 only by loosening the cylinder-case connecting bolts 11, head-cylinder-case connecting bolts 17 and the bolts (not shown) screwed in the bolt holes 18.

In the case where the cam shaft 29 is exchanged by removing the cylinder head 1 and the cylinder block 2 from the front and rear crank cases 3, 4, the sprocket 33 is dismounted from the cam shaft 29 by removing a bolt 33*a* connecting the cam shaft 29 to the sprocket 33 as shown in FIG. 13. In this case, unless the intake cam 41 is aligned to the cutout portion 48 and the exhaust cam 42 and the decompression cam 43 are aligned to the cutout portion 49 after the tappets 50 are removed upward from the front and rear crank cases 3 and 4, the rib 44 is locked with the tappet 50 dropped on the base circle of the intake cam 41 or the intake cam 41, exhaust cam 42 and the decompression cam 43 are locked with the locking stepped portion 47, and thereby the cam shaft 29 cannot be removed. As a result, it becomes possible to prevent an inconvenience that the front and rear crank cases 3, 4 are disassembled by taking out the tappet 50 erroneously dropped in the front and rear crank cases 3, 4.

As shown in FIG. 15, the lubricating oil in the lubricating oil passage 96 is discharged from the lubricating oil hole 98 of the rocker shaft 51 and from the lubricating oil hole 99 of the lubricating oil passage 97 for lubricating the valve system, and in this case, part of the lubricating oil is dropped on the tappets 50 through spaces 100, 101 provided in the cylinder head 1 and the cylinder block 2 for lubricating the sliding portions of the tappets 50. The remainder of the above lubricating oil is also dropped on the cam shaft 29 through a communication hole 102, being dammed up by the projecting ribs 77, and is introduced in the intake cam 41, exhaust cam 42, and the recessed portions 75 of the base circles 73, thus sufficiently lubricating the sliding portions between the intake cam 41 and the exhaust cam 42, and the tappets 50.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating section for a cam sliding surface in an internal combustion engine comprising:

a cam shaft having at least one cam surface defining a base circle for operatively imparting motion to a cam follower;

at least one recessed portion extending in an axial direction of said cam shaft, said recessed portion being formed on said base circle of said cam surface;

projecting ribs extending across a predetermined circumference of said cam shaft; and rib end portions formed on said projecting ribs, said rib end portions being directed toward the recessed portion and extending in the rotational direction of said cam shaft and radially projecting on said cam shaft adjacent to the recessed portion for providing a source of lubrication for said cam follower.

2. The lubricating section for a cam sliding surface according to claim 1, and further including a lubricating oil passageway for supplying lubricating oil to said projecting ribs.

3. The lubricating section for a cam sliding surface according to claim 1, wherein said cam follower includes a tappet disposed between a push rod and said cam surface, said recessed portion supplying lubricating oil to one side of said tappet.

4. The lubricating section for a cam sliding surface according to claim 1, wherein said cam shaft includes two cam surfaces defining base circles for operatively imparting motion to two cam followers, at least one recessed portion being formed on said base circle of each of said cam surfaces.

5. The lubricating section for a cam sliding surface according to claim 1, wherein said projecting ribs extend across said predetermined circumference of said cam shaft at an angle relative to the axial direction to assist in the positioning of lubrication within said recessed portion during rotation of said cam shaft.

6. The lubricating section for a cam sliding surface according to claim 1, wherein said recessed portion is a groove formed on said cam surface for retaining a predetermined quantity of lubrication therein during rotation of said cam shaft.

7. The lubricating section for a cam sliding surface according to claim 4, wherein said projecting ribs extend between the two cam surfaces for supplying lubrication for both of the cam followers.

8. The lubricating section for a cam sliding surface according to claim 7, wherein said recessed portion is a groove formed on each of said cam surfaces for retaining a predetermined quantity of lubrication therein during rotation of said cam shaft.

9. A lubricating section for a cam sliding surface in an internal combustion engine comprising:

a cam shaft having at least one cam surface defining a base circle for operatively imparting motion to a cam follower;

at least one recessed portion extending in an axial direction of said cam shaft, said recessed portion being formed on said base circle of said cam surface;

projecting ribs extending across a predetermined circumference of said cam shaft for directing lubrication into said recessed portion.

10. The lubricating section for a cam sliding surface according to claim 9, and further including rib end portions formed on said projecting ribs, said rib end portions being directed toward the recessed portion for supplying lubrication for said cam follower.

11. The lubricating section for a cam sliding surface according to claim 9, and further including a lubricating oil passageway for supplying lubricating oil to said projecting ribs.

12. The lubricating section for a cam sliding surface according to claim 9, wherein said cam follower includes a tappet disposed between a push rod and said cam surface, said recessed portion supplying lubricating oil to one side of said tappet.

13. The lubricating section for a cam sliding surface according to claim 9, wherein said cam shaft includes two cam surfaces defining base circles for operatively imparting motion to two cam followers, at least one recessed portion being formed on said base circle of each of said cam surfaces.

14. The lubricating section for a cam sliding surface according to claim 9, wherein said projecting ribs extend across said predetermined circumference of said cam shaft at an angle relative to the axial direction to assist in the positioning of lubrication within said recessed portion during rotation of said cam shaft.

15. The lubricating section for a cam sliding surface according to claim 9, wherein said recessed portion is a groove formed on said cam surface for retaining a predetermined quantity of lubrication therein during rotation of said cam shaft.

16. The lubricating section for a cam sliding surface according to claim 13, wherein said projecting ribs extend between the two cam surfaces for supplying lubrication for both of the cam followers.

17. The lubricating section for a cam sliding surface according to claim 16, wherein said recessed portion is a groove formed on each of said cam surface for retaining a predetermined quantity of lubrication therein during rotation of said cam shaft.

* * * * *